United States Patent [19]

Rozmus

[11] 4,391,614

[45] Jul. 5, 1983

[54] METHOD AND APPARATUS FOR PREVENTING LUBRICANT FLOW FROM A VACUUM SOURCE TO A VACUUM CHAMBER

[75] Inventor: Walter J. Rozmus, Traverse City, Mich.

[73] Assignee: Kelsey-Hayes Company, Romulus, Mich.

[21] Appl. No.: 321,935

[22] Filed: Nov. 16, 1981

[51] Int. Cl.[3] ..... B03C 9/00; B65B 31/04

[52] U.S. Cl. ..... 55/2; 55/3; 55/100; 55/385 R; 55/138; 55/152; 141/65; 361/226; 417/49

[58] Field of Search ..... 55/2, 3, 100, 101, 138, 55/52, 154, 385 R, 136, 137, 128, 129; 141/65, 66; 361/226; 417/48, 49

[56] References Cited

U.S. PATENT DOCUMENTS

| | | | |
|---|---|---|---|
| 2,004,352 | 6/1935 | Simon | 55/138 |
| 3,555,818 | 1/1971 | Vlier | 55/152 |
| 3,747,299 | 7/1973 | Chiang | 55/2 |
| 3,786,130 | 1/1974 | Baker | 141/65 |
| 3,957,462 | 5/1976 | Schminke et al. | 55/152 |
| 4,056,368 | 11/1977 | Rozmus | 55/2 |
| 4,108,615 | 8/1978 | Satterthwaite | 55/138 |

*Primary Examiner*—David L. Lacey

*Attorney, Agent, or Firm*—Harold W. Milton, Jr.

[57] ABSTRACT

A method of trapping lubricant in a vacuum system and an assembly for performing same wherein a vacuum chamber has an outlet duct to a vacuum source to establish a gas flow path from the vacuum chamber to the vacuum source. Lubricant vapors from the vacuum source such as a vacuum pump are prevented from entering the vacuum chamber in accordance with the instant invention by establishing an electric field and subjecting the lubricant entering the vacuum outlet duct from the vacuum source to the electric field to electrically charge the lubricant and electrically attract the lubricant back toward the vacuum source. A magnetic field is also established between the electrodes to further urge the charged lubricant back toward the vacuum source. In this manner the lubricant is prevented or substantially prevented from entering and contaminating the vacuum chamber.

2 Claims, 2 Drawing Figures

METHOD AND APPARATUS FOR PREVENTING LUBRICANT FLOW FROM A VACUUM SOURCE TO A VACUUM CHAMBER

TECHNICAL FIELD

The subject invention is to be utilized in a vacuum system wherein a vacuum chamber has a vacuum outlet duct connected to a vacuum source to establish a gas flow path from the vacuum chamber through the outlet to the vacuum source and wherein the vacuum source utilizes a lubricant.

BACKGROUND ART

When a vacuum source, such as a vacuum pump, which utilizes a lubricant, is operated to withdraw gases from a vacuum chamber, the lubricant of the pump may become vaporized and when the vacuum becomes very low and the pressure becomes approximately equal in the pump to that in the vacuum chamber, the lubricant vapor may find its way into the vacuum chamber. Lubricant vapors entering the vacuum chamber may be highly undesirable and contaminate the vacuum chamber.

STATEMENT OF INVENTION AND ADVANTAGES

A method of preventing lubricant contaminants from entering a vacuum system and an assembly for performing same wherein a vacuum chamber has an outlet connected to a vacuum source to establish a stream of gas flow from the vacuum chamber to the vacuum source. Lubricant vapors from the vacuum source such as a vacuum pump are prevented from entering the vacuum chamber in accordance with the instant invention by establishing an electric field and subjecting the lubricant entering the vacuum outlet from the vacuum source to the electric field to electrically charge the lubricant and electrically attract the lubricant back toward the vacuum source. The electric field is established by positioning first and second electrodes in spaced relationship to one another between the vacuum chamber and the vacuum source with the first electrode positioned closer to the vacuum chamber than the second electrode. An electrical potential is established between the electrodes so that the lubricant is charged by the first electrode and is thereby attracted to the second electrode. A magnetic field is established between the electrodes to urge the charged lubricant toward the second electrode. In this manner the lubricant is prevented or substantially prevented from entering and contaminating the vacuum chamber.

FIGURES OF THE DRAWINGS

Other advantages of the present invention will be readily appreciated as the same becomes better understood by reference to the following detailed description when considered in connection with the accompanying drawings wherein:

FIG. 1 is a fragmentary perspective view cut away and in cross section of one embodiment of the invention; and FIG. 2 is a fragmentary perspective view cut away and in cross section of a second embodiment of the invention.

DETAILED DESCRIPTION OF THE DRAWINGS

Figure 1:
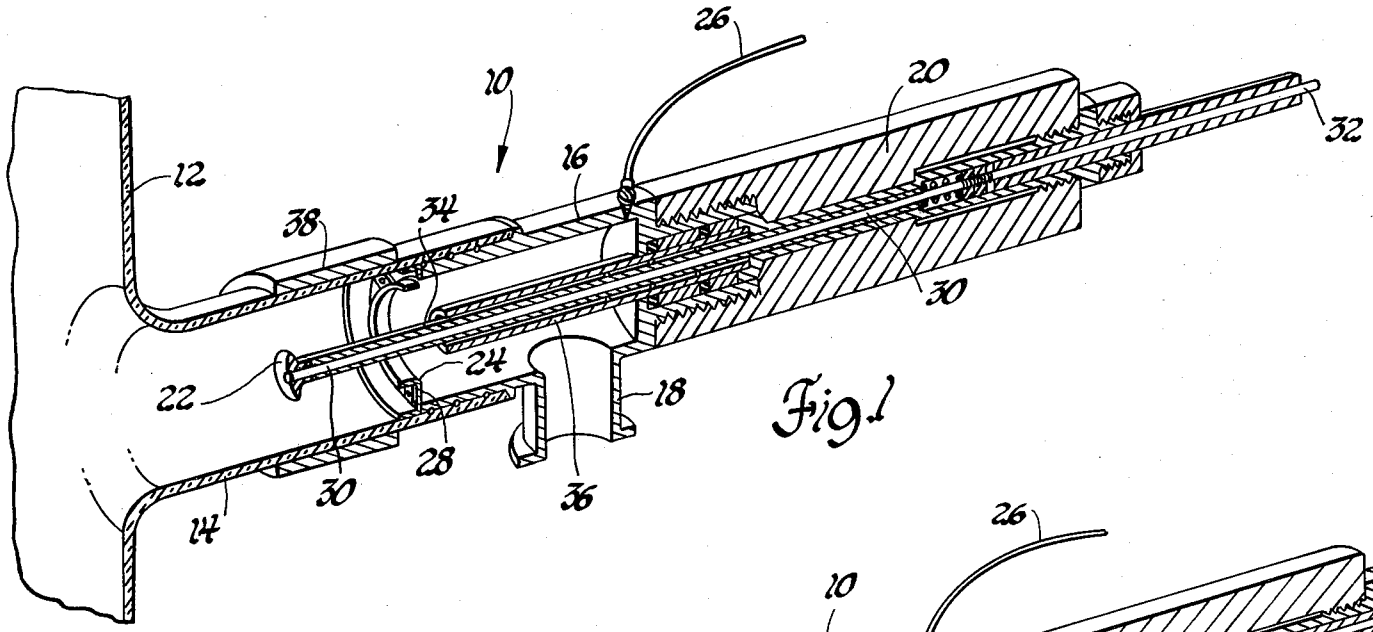

An assembly constructed in accordance with the instant invention is generally shown at 10. The assembly 10 includes a vacuum chamber 12. The vacuum chamber 12 may be of any configuration and will depend upon the use of the vacuum chamber. A vacuum outlet duct 14 is integrally formed with the vacuum chamber 12 and extends laterally therefrom. The chamber and vacuum outlet duct 14 are made of an electrically nonconductive material such as glass. The vacuum outlet duct 14 is tubular and is disposed in sealing engagement about a support member 16. The support member 16 is preferably of an electrically conductive material such as a metal. The support member 16 includes an outlet conduit 18 which would be connected to a vacuum source (such as a vacuum pump) to establish a gas flow path from the vacuum chamber 12 through the outlet duct 14 and conduit 18 to the vacuum source.

The support member 16 threadally engages and is supported by a member 20 which is preferably made of an electrically nonconductive material such as Lucite.

Figure 2:
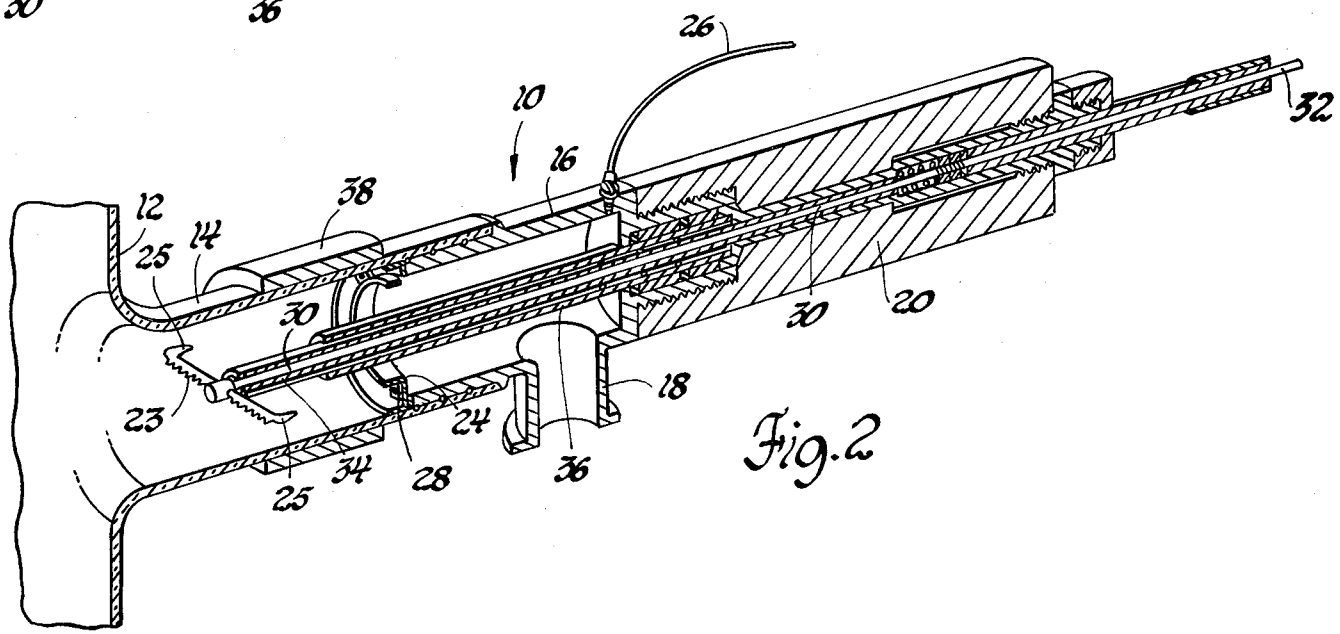

Disposed within the outlet duct 14 is an electric field-producing means for producing an electric field to subject the lubricant entering the vacuum outlet through the conduit 18 from the vacuum source to the electric field to electrically charge the lubricant and electrically attract the lubricant back toward the vacuum source. This substantially prevents any lubricant vapor from entering and contaminating the vacuum chamber 12. The electric field-producing means includes a pair of first and second electrodes 22 and 24 in FIG. 1 and 23 and 24 in FIG. 2, the only difference between the embodiments of FIGS. 1 and 2 being the configuration of the first electrodes 22 and 23. The first electrode 22 of FIG. 1 is a round disc having a sharp periphery for facilitating the emission of electrons. The first electrode 23 of the embodiment of FIG. 2 comprises a cross bar having serrations or teeth therein to define sharp portions and spikes 25 at the outward ends of the cross arm having pointed ends extending in the direction of the gas flow out through the gas outlet duct 14.

The first and the second electrodes 22, 23 and 24 are spaced from one another along the gas flow path out through the outlet duct 14.

There is included a power means for establishing an electrical potential between the electrodes 22 and 24 and between the electrodes 23 and 24. Preferably the support member 16 is grounded through an appropriate electrical lead 26. The electrodes 24 comprise a pair of annular concentric rings interconnected by three equally spaced bridges 28. Each of the bridges 28 is connected by an appropriate screw or fastening means to the end face of the support member 16 and is, therefore, also grounded. A shaft 30 extends in a cantilevered fashion from the support member 16 to a distal end supporting the electrodes 22 and 23. The shaft 30 is electrically connected through a connector 32 to an appropriate power source, preferably one furnishing a positive charge. The shaft 30 has a tubular insulator 34 to insulate the shaft from the interior of the outlet and to prevent the establishment of a potential between the shaft and the electrode 24. Because the support member 16 is grounded, an additional tubular insulating member 36 is disposed about the tubular member 34 on the shaft 30 to prevent any establishment of a potential between the shaft 30 and the grounded support member 16.

Thus, the first electrodes 22 and 23 are positioned upstream in the gas flow path from the second electrodes 24. The power means establishes a charge upon the electrodes 22 and 23 to establish a potential between the electrodes 22 and 24 and 23 and 24 so that the oil that may enter the outlet duct conduit 18 and into the outlet 14 would be charged by the electrodes 22 and 23 and thereby attracted back to the second electrodes 24. Preferably, the first electrodes 22 and 23 would be positively charged, however, it will be appreciated that they may be either positively or negatively charged whereby the grounded support member 16 would be neutral with respect thereto, yet there would be established a potential between the electrodes.

In addition, there is included a magnet 38 disposed about the tubular outlet duct 14 on the exterior thereof and positioned to extend between the first and second electrodes to establish lines of flux to urge the charged oil vapor within the outlet duct tube 14 to move toward the second electrodes 24.

Accordingly, lubricant in the form of a vapor or lubricant molecules entering the vacuum outlet duct 14 from the vacuum source through the conduit 18 is subjected to an electric field to electrically charge the lubricant and electrically attract the lubricant back toward the vacuum source. This is accomplished by positioning the first and second electrodes 22 and 24 and 23 and 24 in spaced relationship to one another along the gas flow path in the vacuum outlet duct 14 and establishing an electrical potential between the electrodes whereby the oil is charged by the first electrodes 22 and 23 upstream in the gas flow path so that the lubricant is attracted back toward the downstream electrodes 24 which movement of the lubricant is aided and abetted by the magnetic lines of flux established by the magnets 38.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. An assembly comprising; a vacuum chamber (12) having a vacuum outlet duct (14) for connection to a vacuum source to establish a stream of gas flow from said vacuum chamber (12) through said outlet duct (14) to a vacuum source, said assembly further comprising electric field-producing means (22, 23, 24) for producing an electric field to subject the lubricant entering the vacuum outlet duct (14) from a vacuum source to the electric field to electrically charge the lubricant and electrically attract the lubricant back toward a vacuum source, said electric field-producing means including a pair of first (22, 23) and second (24) electrodes spaced from one another between said vacuum chamber (12) and a vacuum source and power means (26, 32) for establishing an electrical potential between said electrodes, said first electrode (22, 23) being positioned closer to said vacuum chamber (12) than said second electrode (24), said power means establishing a potential so that the lubricant is charged by said first electrode (22, 23) and is thereby attracted back to said second electrode (24), and a magnet (38) positioned and arranged to establish a magnetic field extending between said electrodes to urge the charged lubricant toward said second electrode.

2. A method for preventing lubricant from entering a vacuum chamber (12) through an outlet duct (14) connected to a vacuum source comprising the steps of; establishing an electric field and subjecting the lubricant entering the vacuum outlet duct (14) from the vacuum source to the electric field to electrically charge the lubricant and electrically attracting the lubricant back toward the vacuum source, establishing the electric field by positioning first (22, 23) and second (24) electrodes in spaced relationship to one another between the vacuum chamber (12) and the vacuum source, positioning the first electrode (22, 23) closer to the vacuum chamber (12) than the second electrode, establishing an electrical potential between the electrodes so that the lubricant is charged by the first electrode (22, 23) and is thereby attracted back to the second electrode (24), establishing a magnetic field between the electrodes (22, 23 and 24) to urge the charged lubricant toward the second electrode (24).

* * * * *